US009950371B2

(12) United States Patent
Roche et al.

(10) Patent No.: US 9,950,371 B2
(45) Date of Patent: Apr. 24, 2018

(54) METHOD AND FACILITY FOR TRANSFORMING A LIQUID-STATE METAL INTO A SOLID-STATE METAL

(71) Applicant: FAI Production, Domène (FR)

(72) Inventors: Christian Roche, Savièse (CH); Arthur Traub, Gières (FR)

(73) Assignee: FAI PRODUCTION, Domène (FR)

( * ) Notice: Subject to any disclaimer, the term of this patent is extended or adjusted under 35 U.S.C. 154(b) by 116 days.

(21) Appl. No.: 14/773,254

(22) PCT Filed: Mar. 3, 2014

(86) PCT No.: PCT/EP2014/054096

§ 371 (c)(1),
(2) Date: Sep. 4, 2015

(87) PCT Pub. No.: WO2014/135501

PCT Pub. Date: Sep. 12, 2014

(65) Prior Publication Data

US 2016/0016231 A1 Jan. 21, 2016

(30) Foreign Application Priority Data

Mar. 6, 2013 (FR) ..... 13 52004

(51) Int. Cl.
*B22D 5/00* (2006.01)
*B22D 11/00* (2006.01)
(Continued)

(52) U.S. Cl.
CPC ..... *B22F 9/06* (2013.01); *B22D 5/00* (2013.01); *B22D 11/00* (2013.01); *B22F 9/04* (2013.01); *B22F 9/08* (2013.01); *B22F 2009/047* (2013.01)

(58) Field of Classification Search
CPC ..... B22D 5/00; B22D 11/00; B22D 11/114; B22F 9/04; B22F 9/06; B22F 2009/047
(Continued)

(56) References Cited

U.S. PATENT DOCUMENTS 1,729,631 A * 10/1929 Stay ..... C22B 7/003 366/144
1,816,059 A * 7/1931 Smith ..... B22D 25/04 164/267

(Continued)

FOREIGN PATENT DOCUMENTS

FR 2 885 544 A1 11/2006

OTHER PUBLICATIONS

Bullón, J., and A. More, "The New Copper Casting-Machine: Experiences at FerroAtlantica," Proceedings of the 10th International Ferroalloys Congress (INFACON X), Feb. 1-4, 2004, Cape Town, South Africa, pp. 147-154.

(Continued)

*Primary Examiner* — Kevin P Kerns
(74) *Attorney, Agent, or Firm* — Christensen O'Connor Johnson Kindness PLLC

(57) ABSTRACT

Method and installation for converting a metal in the liquid state into a fragmented metal in the solid state. The metal in the liquid state is poured on an upstream portion of a receiving surface (7) of a first cooled vibrating table (4). The metal falls from the downstream end of the first table on an upstream portion of a receiving surface (17) of a second cooled vibrating table (5). The fragmented and solidified metal is discharged at the downstream end of the receiving surface of that second table. A rotary fragmentation roller (102) may be positioned above a table. The tables comprise an upstream cooling zone (7) by means of a liquid/gas emulsion and a downstream cooling zone (17) by means of a liquid.

25 Claims, 9 Drawing Sheets

(51) Int. Cl.
*B22F 9/06* (2006.01)
*B22F 9/08* (2006.01)
*B22F 9/04* (2006.01)

(58) Field of Classification Search
USPC ..... 164/71.1, 260, 416, 478; 75/354
See application file for complete search history.

(56) References Cited

U.S. PATENT DOCUMENTS 3,677,324 A * 7/1972 Higginbotham et al. ..... C30B 11/001 164/122.1
3,707,182 A 12/1972 Wiley et al.
3,741,281 A * 6/1973 Hauser-Lienhard .... B22C 9/046 164/253

OTHER PUBLICATIONS

Bullón, J., et al., "The Improvements to Copper Casting Machine for Ferroalloys," Proceedings of the 11th International Ferroalloys Congress (INFACON XI), Feb. 18-21, 2007, New Delhi, India, pp. 539-547.
International Search Report dated Oct. 9, 2014, issued in corresponding International Application No. PCT/EP2014/054096, filed Mar. 3, 2014, 6 pages.

* cited by examiner

METHOD AND FACILITY FOR TRANSFORMING A LIQUID-STATE METAL INTO A SOLID-STATE METAL

The present invention relates to the field of the metallurgical industry.

After a metal previously obtained from ore has been processed in a reduction oven, it is necessary to carry out a processing phase which involves obtaining, from the metal in the liquid state, fragments of metal in the solid state, having specific dimensions. Such a requirement for products in the form of fragments particularly relates to ferroalloys and silicon metal.

Currently, there is carried out a method of cooling and fragmentation which involves producing a bowl from sand, pouring the metal in the liquid state into that bowl in order to form a block and destroying and grinding or crushing that block in order to obtain fragments of metal in the solid state.

Such a method requires that, for each casting operation, a bowl be made from sand and that a very expensive installation be provided for destroying and grinding the blocks. That method is particularly long to carry out and therefore expensive and involves a great production of fines or metal powders which are undesirable and may reach 15% of the production.

The U.S. Pat. No. 3,707,182 describes a rotary table on which a liquid material is poured. The table is cooled in a uniform manner, so that the material becomes solidified and fragments.

An object of the present invention is to substantially reduce the production times for fragments of a metal in the solid state from a metal in the liquid state, by producing an installation which is relatively simpler and less expensive and which ensures relatively controlled sizing of the fragments.

Firstly, there is proposed a method for converting a metal in the liquid state into a fragmented metal in the solid state, on at least two mutually successive tables.

This method comprises:

pouring the metal in the liquid state on an upstream portion of a first receiving surface of a first cooled table, vibrating the first table so that the metal moves toward a downstream end of the receiving surface of that first table, causing the metal to fall from the downstream end of the first table on an upstream portion of a second receiving surface of a second cooled table, vibrating the second table so that the metal moves toward a downstream end of the receiving surface of that second table, passing the metal below at least one rotary transverse fragmentation roller which is positioned above a downstream table which is located downstream of the first table, vibrating the downstream table so that the metal moves toward a downstream end of the receiving surface of that last downstream table, and discharging the fragmented and solidified metal at the downstream end of the receiving surface of that last downstream table.

The metal is preferably solidified when it reaches the fragmentation roller.

The method may comprise: circulating an emulsion of a liquid and a gas in transverse channels of an upstream cooling zone and circulating a liquid in transverse channels of a downstream cooling zone, those cooling zones being mutually successive in the longitudinal direction of the receiving tables.

The second table may constitute the downstream table.

The method may comprise:

passing the metal on the receiving surface of at least one cooled intermediate table which is located between the second table and the downstream table, causing the metal to fall from one table to the other, vibrating the intermediate table so that the metal moves toward a downstream end of the receiving surface of that intermediate table.

The fragmentation roller may be subjected, over a first path, to first springs and, over a second path which extends the first path, to second springs which supplement the first springs.

There is also proposed an installation for converting a metal in the liquid state into a fragmented metal in the solid state.

An installation may comprise:

a first vibrating table comprising a first receiving surface for the metal having an upstream end and a downstream discharge end, cooling means for the first table, means for vibrating the first table so that the metal moves in a downstream direction, means for pouring the metal in the liquid state on an upstream portion of the first receiving surface of the first table, a second vibrating table comprising a second receiving surface for the metal having an upstream end and a downstream discharge end, the upstream portion of the receiving surface of the second table being located below and with spacing from the downstream end of the first receiving surface of the first table, so that the metal falls from the first table on the second table, cooling means for the second table, means for vibrating the second table so that the metal moves in a downstream direction, a downstream vibrating table comprising a receiving surface for the metal having an upstream end and a downstream discharge end and means for vibrating the downstream table so that the metal moves in a downstream direction, at least one rotary fragmentation roller which is positioned above that downstream table and transversely to the movement of the metal on that table.

The second table may constitute the downstream table.

The installation may comprise at least one intermediate table which is located between the second table and the downstream table, means for vibrating that intermediate table and cooling means for that intermediate table.

The tables may comprise receiving plates which are selected to be of copper, with the exception of at least the portion of the downstream table which is located below the fragmentation roller which comprises a plate which is selected to be of steel.

The means for vibrating the tables may be common.

The means for vibrating the tables may be separate.

The tables may comprise plates, the cooling means having circulation channels for a cooling fluid, which are configured inside those plates.

The tables may comprise, in an upstream zone of the installation, at least one plate having circulation channels which are provided with injectors for a cooling liquid/gas emulsion and, in a downstream zone following the upstream zone, at least one plate which has circulation channels for a cooling liquid.

The installation may comprise suspension means for the fragmentation roller including restoring springs.

The suspension means may comprise rocker arms, on which the ends of the fragmentation roller are mounted so as to rotate, movable support means for those rocker arms, restoring means for the fragmentation roller acting counter to movements of the rocker arms in relation to the movable support means and restoring means acting counter to the movements of the movable supports.

The restoring means may be pretensioned at the position of equilibrium.

The fragmentation roller may be positioned above a downstream portion of the downstream table.

The fragmentation roller may be provided at the periphery thereof with a plurality of projecting fingers.

At least the upstream portion of the receiving surface of the first table is inclined in a downstream direction.

An installation for converting a metal in the liquid state into a fragmented metal in the solid state may comprise:

a plurality of vibrating tables which are provided with receiving plates which are mutually successive in a downstream direction and which have receiving surfaces for the metal, means for pouring the metal in the liquid state on an upstream portion of the upstream table, means for vibrating the tables so that the metal moves in a downstream direction, at least one rotary fragmentation roller which is positioned above the downstream table and transversely to the movement of the metal on that table, the receiving plates being selected to be of copper and being provided with cooling means, with the exception of the receiving plate which is located below the rotary fragmentation roller which is selected to be of a steel.

At least two successive receiving plates may be greatly offset in the vertical direction so that the metal falls from one on the other.

The installation may comprise an upstream zone in which at least one plate has circulation channels which are provided with injectors for a cooling liquid/gas emulsion and a downstream zone which follows the upstream zone and in which at least one plate has circulation channels for a cooling liquid.

The installation may comprise suspension means for the fragmentation roller including restoring springs.

In this installation, at least the upstream portion of the receiving surface of the first table or upstream table is inclined in a downstream direction.

An installation may comprise:

a table having a receiving surface which is for the metal and on which the metal moves in a downstream direction;

at least one rotary fragmentation roller which is positioned above the receiving table and transversely to the movement of the metal on the receiving plate and suspension means for the fragmentation roller comprising rocker arms, on which the ends of the fragmentation roller are mounted so as to rotate, movable supports for those rocker arms, restoring means for the fragmentation roller acting counter to the movements of the rocker arms in relation to the movable supports and restoring means acting counter to the movements of the movable supports.

An installation may comprise a receiving table, on which the metal moves in a downstream direction, that receiving table comprising, in an upstream zone, at least one plate having circulation channels for a cooling liquid/gas emulsion and, in a downstream zone which follows the upstream zone, plates having circulation channels for a cooling liquid.

An installation may comprise:

a vibrating table having a receiving surface for the metal, means for pouring the metal in the liquid state on an upstream portion of the table, means for vibrating the table so that the metal moves in a downstream direction, wherein at least the upstream portion of the receiving surface of the upstream table is inclined in a downstream direction.

The inclination of the upstream portion of the receiving surface of the first table may be between two and ten degrees.

Installations according to the present invention for converting a metal in the liquid state into a fragmented metal in the solid state, and the operation thereof will now be described by way of non-limiting examples and illustrated by the drawings, in which.

The drawings illustrate an installation 1 for converting a metal in the liquid state into a fragmented metal in the solid state.

That installation 1 is more particularly suitable for such a conversion of metals, such as ferroalloys or silicon metal.

Figure 1:
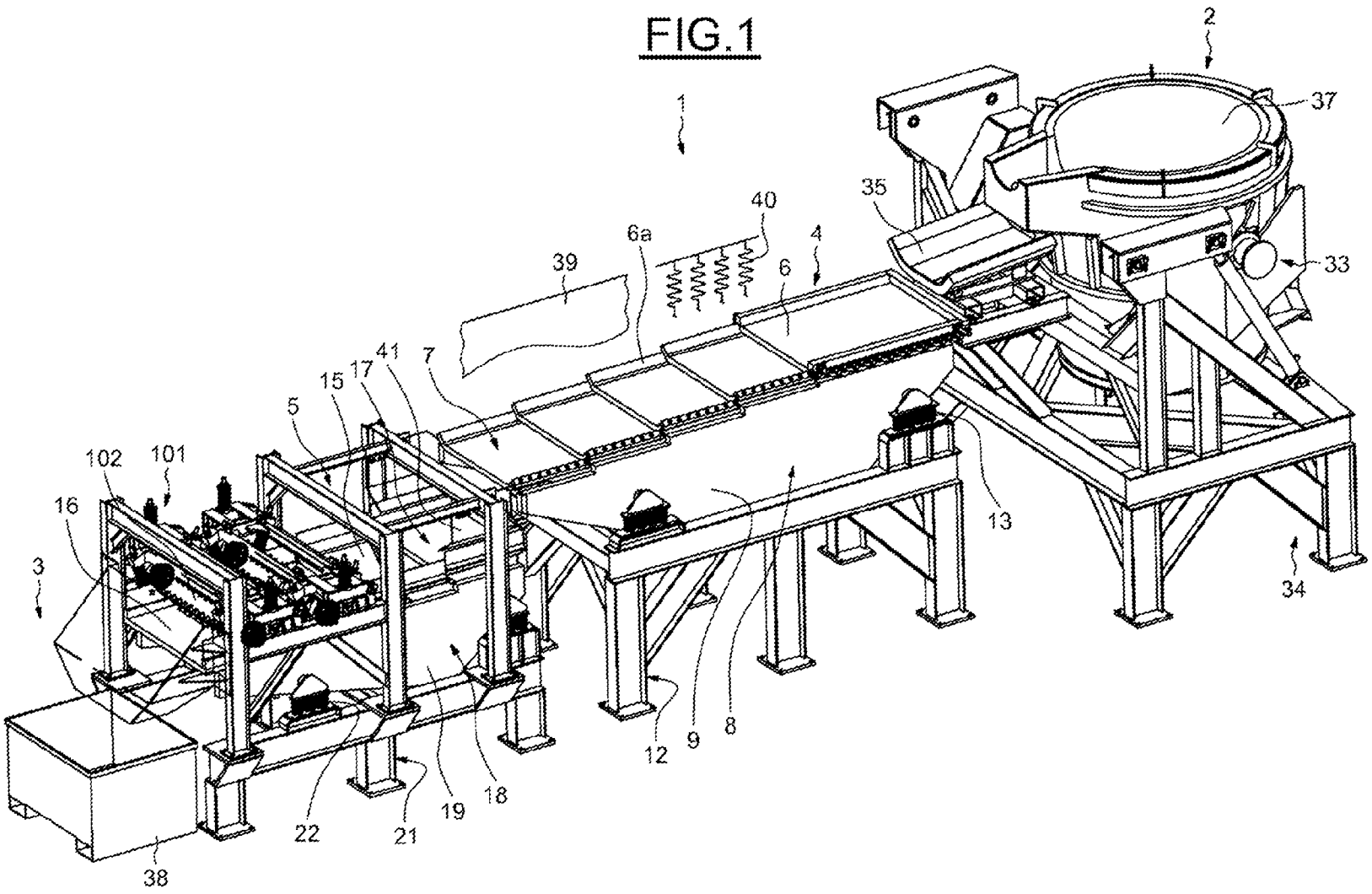
FIG. 1 is a perspective view of an installation.
Figure 2:
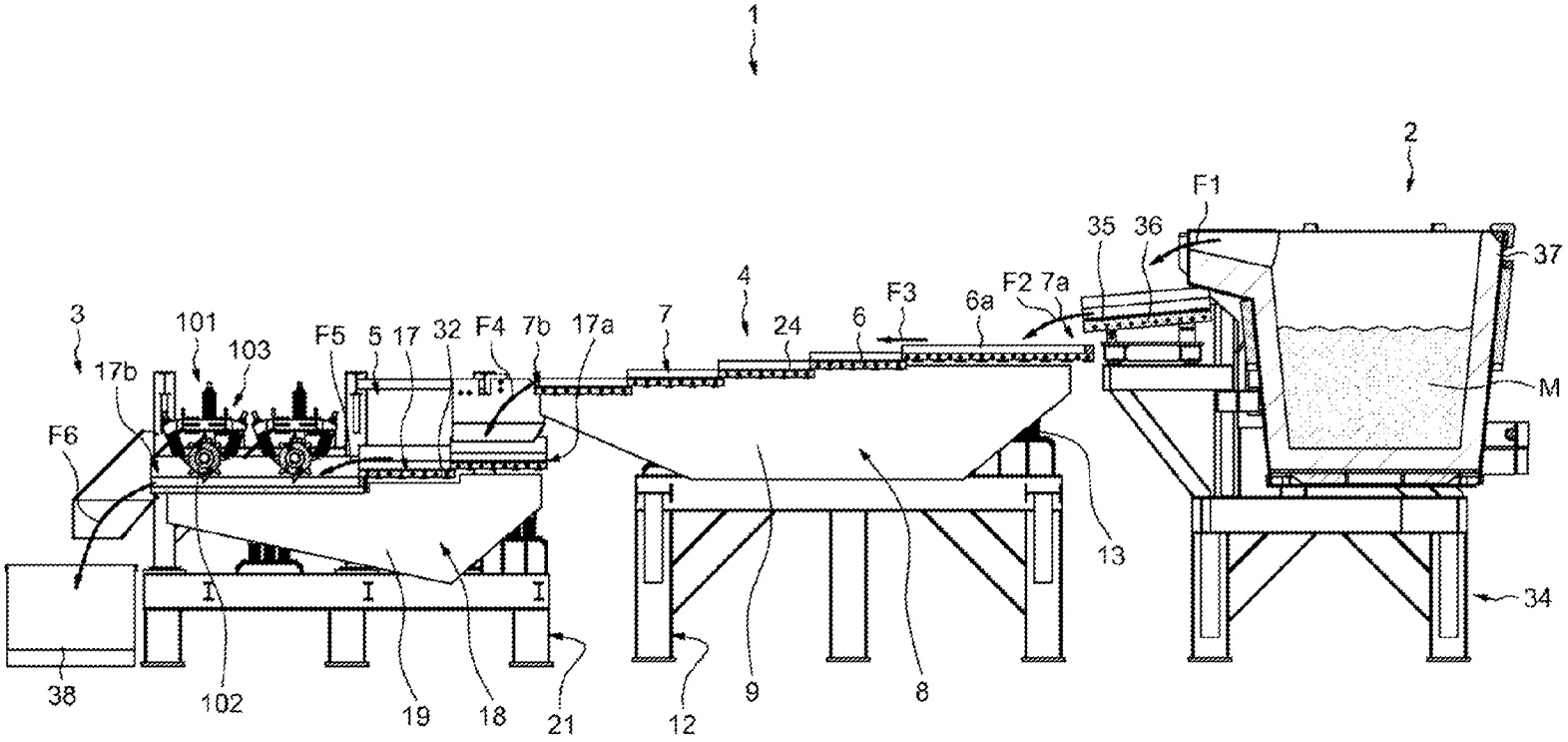
FIG. 2 is a vertical longitudinal section of the installation of FIG. 1.

As illustrated in particular in FIGS. 1 and 2, the installation 1 may comprise successively, between a pouring station 2 and a discharge station 3, a plurality of longitudinal tables in mutual succession, including a first longitudinal table 4 and a second longitudinal table 5, that second table 5 constituting a downstream table of the installation.

Figure 3:
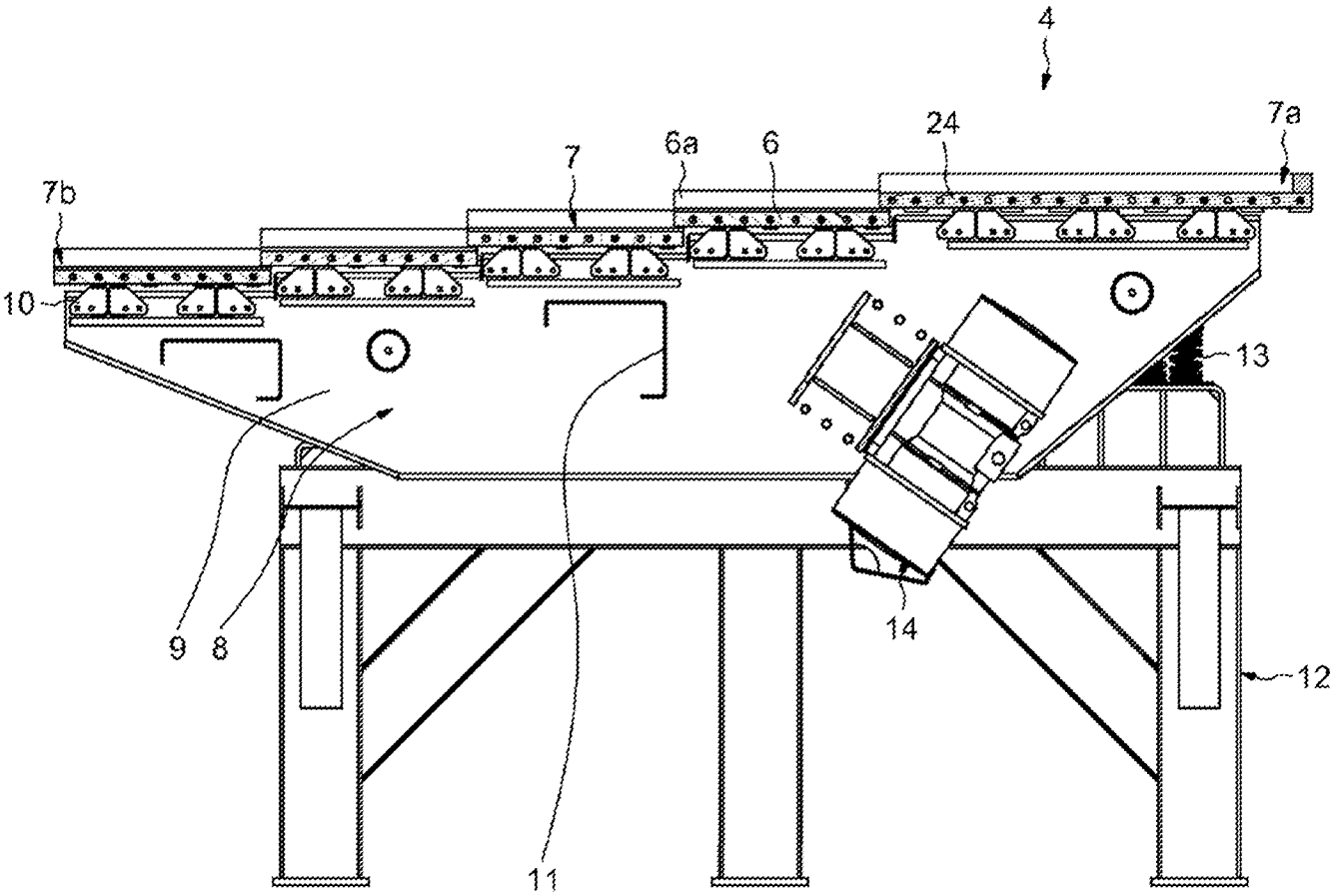
FIG. 3 is a vertical longitudinal section of a first longitudinal table of the installation of FIG. 1.

As illustrated in particular in FIGS. 1, 2 and 3, the first longitudinal table 4 may comprise a plurality of successive plates 6, preferably of copper, for example five, which substantially define a first longitudinal receiving surface 7 which is for the metal and which has an upstream end 7*a* and a downstream end 7*b*.

The successive plates 6 overlap slightly and are vertically offset in steps corresponding substantially to the thicknesses thereof, the upstream plates having downstream transverse edges which are positioned on upstream transverse edges of the downstream plates, the upper face of each plate 6 being substantially horizontal and having longitudinal rims 6*a* which have lateral delimitations and which project upward.

The first table 4 comprises a frame 8 which comprises longitudinal members 9 which extend below the lateral portions of the plates 6 and to which the plates are fixed by means of supports 10, the longitudinal members 9 being connected by cross-members 11.

The frame 8 is mounted on a fixed chassis 12 by means of a plurality of springs 13 and the frame 8 is connected to the chassis 12 by means of a vibration generating member 14 which is capable of vibrating the frame 8.

Figure 4:
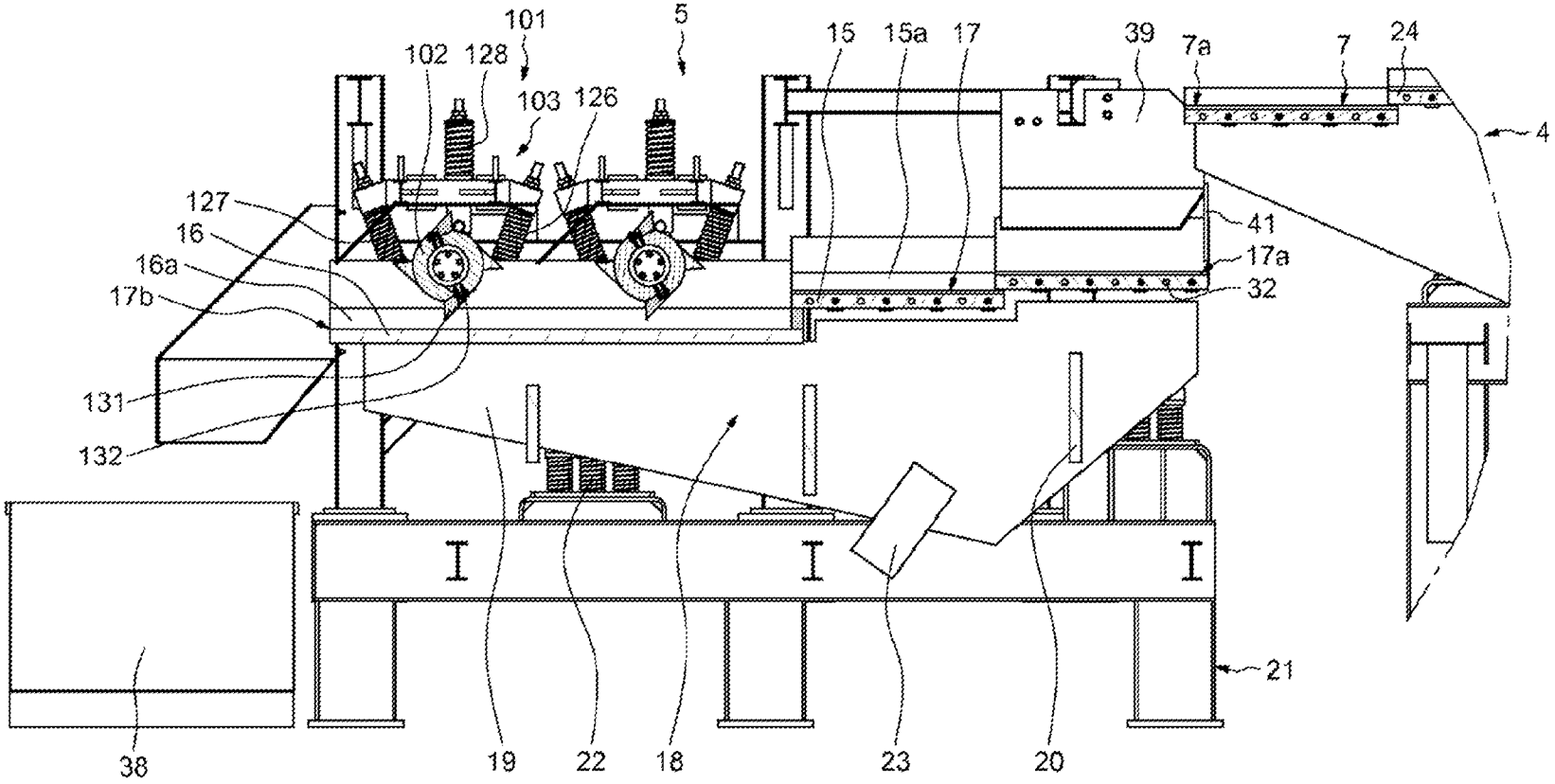
FIG. 4 is a vertical longitudinal section of a second longitudinal table of the installation of FIG. 1.

As illustrated in particular in FIGS. 1, 2 and 4, the second longitudinal table 5 may comprise a plurality of successive plates 15, preferably of copper, for example two, and an end plate 16, preferably of steel, which substantially define a second longitudinal receiving surface 17 for the metal, which surface has an upstream end 17*a* and a downstream end 17*b*.

The successive plates 15 and 16 overlap slightly, the upstream plates having transverse downstream edges which are positioned on transverse upstream edges of the downstream plates, the upper face of each plate being substantially horizontal and having longitudinal rims 15*a* and 16*a* which have lateral delimitations and which project upward.

The second table 4 comprises a frame 18 which comprises longitudinal members 19 which extend below lateral portions of the plates 15 and 16 and to which the plates are fixed, the longitudinal members 19 being connected by cross-members 20.

The frame 18 is mounted on a fixed chassis 21 by means of a plurality of springs 22 and the frame 18 is connected to the chassis 21 by means of a vibration generating member 23 which is capable of vibrating the frame 18.

The second table 4 is positioned in such a manner that an upstream portion of the longitudinal receiving surface 17 thereof is located below and with spacing from the downstream end 7*b* of the longitudinal receiving surface 7 of the first longitudinal table 4, thereby producing a large discontinuity between the first longitudinal receiving surface 7 and the second longitudinal receiving surface 17.

The plates 6 and 15 have pluralities of internal cooling channels which extend transversely in planes parallel with the upper faces thereof and which can be connected to sources of cooling fluids so as to circulate those fluids in those channels in order to cool those plates.

Figure 6:
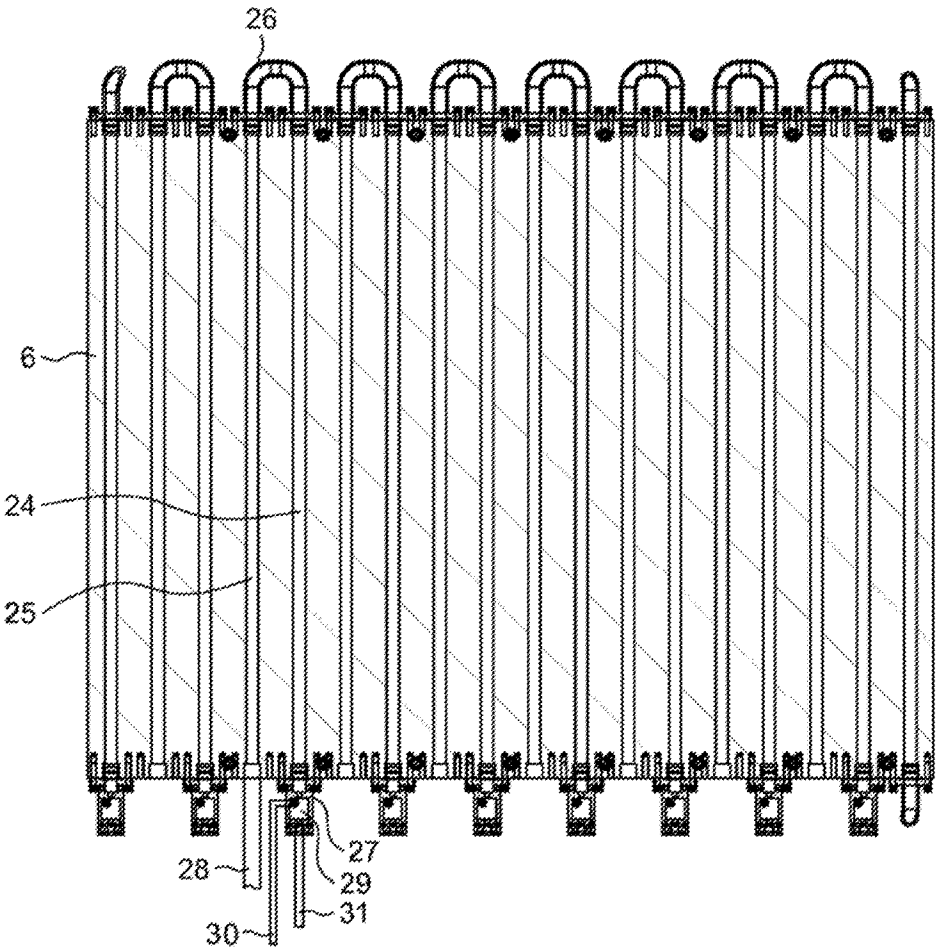
FIG. 6 is a horizontal section of a plate of the first longitudinal table of the installation of FIG. 1.

As illustrated in particular in FIG. 6, each plate 6 of the first table 4 has a plurality of transverse channels which are arranged as pairs of channels 24 and 25, in such a manner that the ends of each pair of channels, which ends are located at one side of that plate, are connected by U-shaped recirculation bends 26, the other ends of which located at the other side of the plate are provided with an injector 27 and connected to an external conduit 28, respectively.

Each injector 27 is fixed to the side of the plate 6 and has an internal emulsion chamber 29, in which a cooling liquid such as water and a cooling gas such as nitrogen are conveyed by external conduits 30 and 31 in order to be mixed and injected axially in each internal channel 24 of the plate 6 in order to be discharged by the corresponding external conduit 28. In this manner, the first longitudinal table 4 forms an upstream cooling zone.

In an equivalent manner, the plates 15 of the second longitudinal table 5 have transverse cooling channels 32 which may be arranged as above, but without the provision of injectors, so as to circulate only a cooling liquid such as water. In this manner, the second longitudinal table 5 forms an upstream cooling zone.

Nevertheless, according to a construction variant, the upstream cooling zone could extend over a portion of the length of the first longitudinal table 4 or extend over the second longitudinal table 5, the downstream cooling zone being configured accordingly.

At the pouring station 2, the installation 1 comprises a fixed chassis 34 which carries a longitudinal inclined ramp 35 which is preferably provided with a refractory material, and which is located above and to the rear of the upstream portion of the receiving surface 7 of the first table 4 and which can also be provided with transverse channels 36 for the cooling thereof by a suitable fluid.

Figure 5:
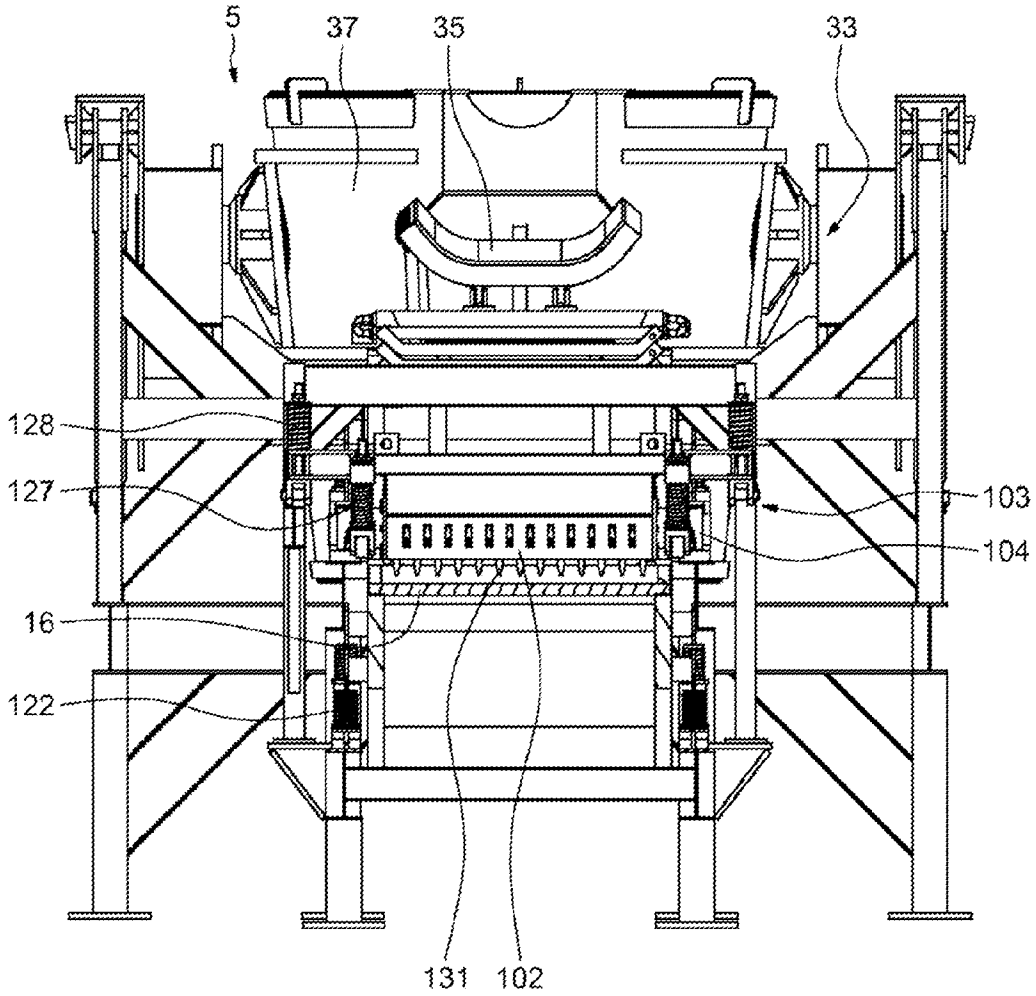
FIG. 5 is an end view, in an upstream direction, of the installation of FIG. 1.

As illustrated in particular in FIGS. 1, 2 and 5, the installation 1 is provided, at the pouring station 2, with handling means 33 in order to receive a ladle 37 and to handle it.

Preferably, the first plate(s) 6 which form(s) the upstream portion of the receiving surface 7 of the first table 4 is/are slightly inclined in a downstream direction, through a few degrees, while all the other plates of the installation may be horizontal. According to a construction variant, all the plates could be slightly inclined in a downstream direction.

The installation 1 can operate and be used as follows.

The vibration generating members 14 and 23 are operational in such a manner that the plates 6 which are carried by the frame 8 of the first longitudinal table 4 vibrate and the plates 15 and 16 which are carried by the frame 18 of the second longitudinal table 5 vibrate, in an independent manner. The cooling fluids circulate in the above-mentioned internal channels of the plates 6 and 15 of the longitudinal tables 4 and 5.

A ladle 37 which contains a metal M in the liquid state or in a molten state is placed at the pouring station 2.

The ladle 37 is handled in order to pour in a controlled manner the metal M on the inclined ramp 35 (FIG. 2, arrow F1).

The metal M in the liquid state, at a temperature slightly higher than the melting temperature thereof, flows and spreads over the inclined ramp 35 and is poured over the upstream portion of the receiving surface 7 of the first table (FIG. 2, arrow F2), further spreading so as to form a sheet (not illustrated).

Under the effect of the vibrations of the first longitudinal table 4, and where applicable the gradient of the receiving surface 7, the metal M in the form of a layer moves in a downstream direction on the receiving surface 7 of the first longitudinal table (FIG. 2, arrow F3) and, simultaneously and progressively, under the effect of the cooling brought about by the cooled plates 6, the metal M cools relatively abruptly, solidifies and cracks so as to form fragments as it advances.

When the metal M reaches the downstream end 7*b* of the first table 4, the fragments thereof are solidified, although the core of the largest fragments may still be viscous.

Subsequently, the fragments of the metal M, some of which may still have excessively large, undesirable dimensions, for example, in the form of tongues, are poured out and fall on the upstream portion of the receiving surface 17 of the second longitudinal table 5 (FIG. 2, arrow F4), from such a height that their fall brings about further fragmentation thereof. This involves a fall from a height which is far greater than the small falls which are brought about when the metal M moves from one receiving plate to another for each of the tables.

Subsequently, under the effect of the vibrations of the second longitudinal table 5 and, simultaneously, under the effect of the cooling brought about by the cooled plates 15, progressively, the fragments of the metal M continue to move in a downstream direction on the receiving surface 17 of the second longitudinal table 5 (FIG. 2, arrow F5) and to cool, where applicable continuing to crack in the form of fragments which are even smaller as they advance.

Subsequently, the fragments obtained, which are solidified and cooled, are poured at the downstream end of the second longitudinal table 5 into a collecting container 38 which is placed at the discharge station 3 (FIG. 2, arrow F6).

As illustrated in FIG. 1, so that fragments of metal do not become projected outside the longitudinal tables 4 and 5, the installation 1 may be provided with vertical plates 39 and/or screens of suspended chains 40, which are placed longitudinally at each side and above the edges of the receiving surfaces 7 and 17 and a plate 41 which is placed transversely below the downstream edge of the first longitudinal table and above the upstream edge of the second longitudinal table. Furthermore, the installation 1 could be provided with covers (not illustrated) extending above and with spacing from the longitudinal tables 4 and 5 and above the discharge station.

By way of non-limiting example, the first longitudinal table 4 and the second longitudinal table 5 could be connected to each other and mounted on a common fixed chassis. In that case, the first longitudinal table 4 and the second longitudinal table 5 could be subjected to a common vibration generating member.

The difference in level between the downstream portion of the first longitudinal table and the upstream portion of the second longitudinal table may be greater than twelve percent of the length of the first table. In particular, the length of the first longitudinal table 4 could be between four and six meters and the height of the fall between the first longitudinal table 4 and the second longitudinal table 5 could be between sixty and ninety centimeters.

The length of the second longitudinal table 5 could be between two and four meters.

The width of the longitudinal tables 4 and 5 may be between two and four meters.

The thickness of the plates 6, 15 and 16 could be between six and eight centimeters, the small falls between the plates of each table being in proportion to those thicknesses.

The thickness of the sheet of metal M, after the liquid metal has been poured out, may be between one half and ten centimeters.

In the case of a metal M whose melting temperature is approximately 1750° C. (degrees Celsius), for example, silicon metal, the temperature of the fragments of that metal when they reach the end of the first longitudinal table 4 may be between 400° C. and 800° C. and the temperature of the fragments of that metal when they reach the end of the second longitudinal table 5 may be between 150° C. and 300° C.

Furthermore, the plates 6 and 15 of copper may be covered, at least at the upper receiving surfaces thereof for the metal M, with a protection layer such as, for example, zircon or graphite.

As illustrated in particular in FIGS. 1 and 2, the installation 1 may further comprise at least one mechanism 101 having a transverse fragmentation roller, which is positioned, for example, above the end receiving plate 16 of the second longitudinal table 5. According to the example illustrated, two mechanisms 101 which are longitudinally offset in a downstream direction are provided.

Figure 7:
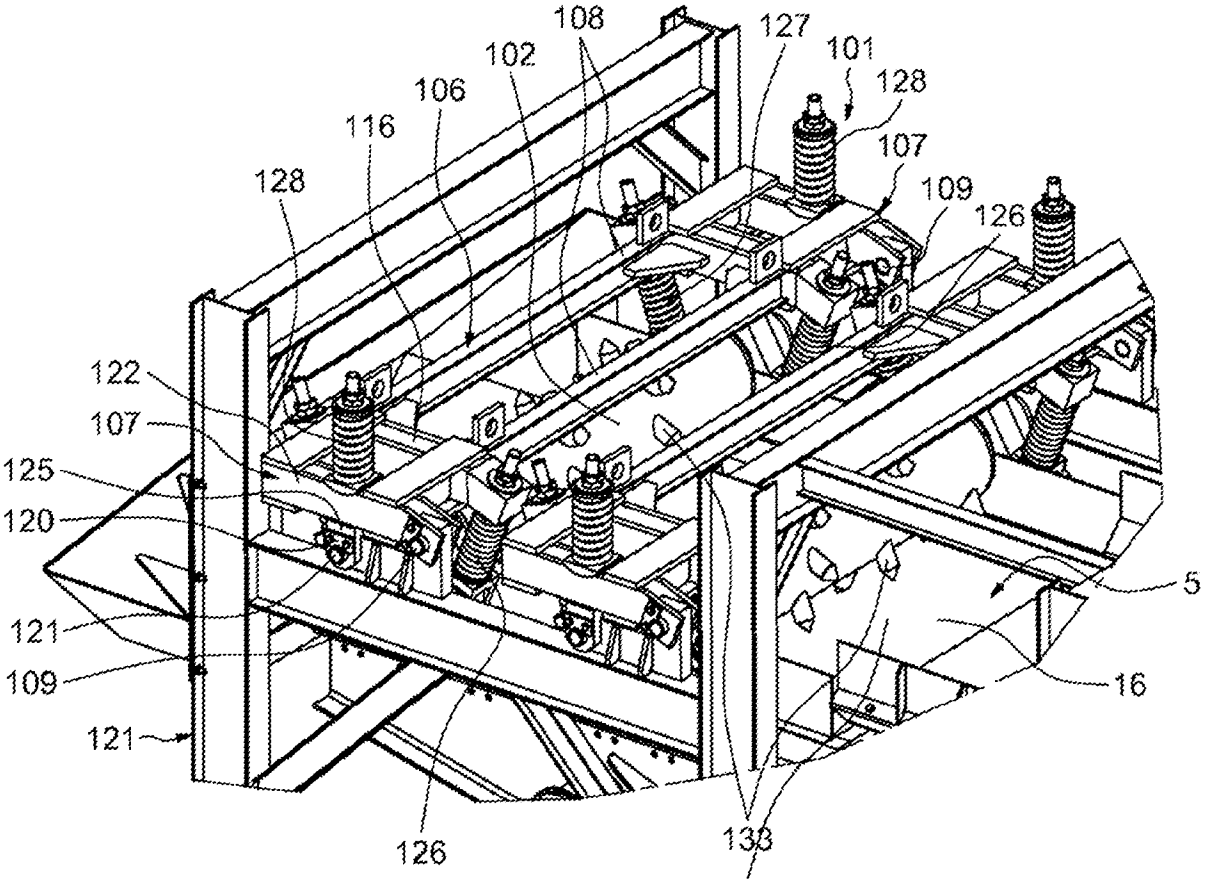
FIG. 7 is a perspective view of a downstream portion of the second longitudinal table of the installation of FIG. 1, illustrating a mechanism having a fragmentation roller.
Figure 8:
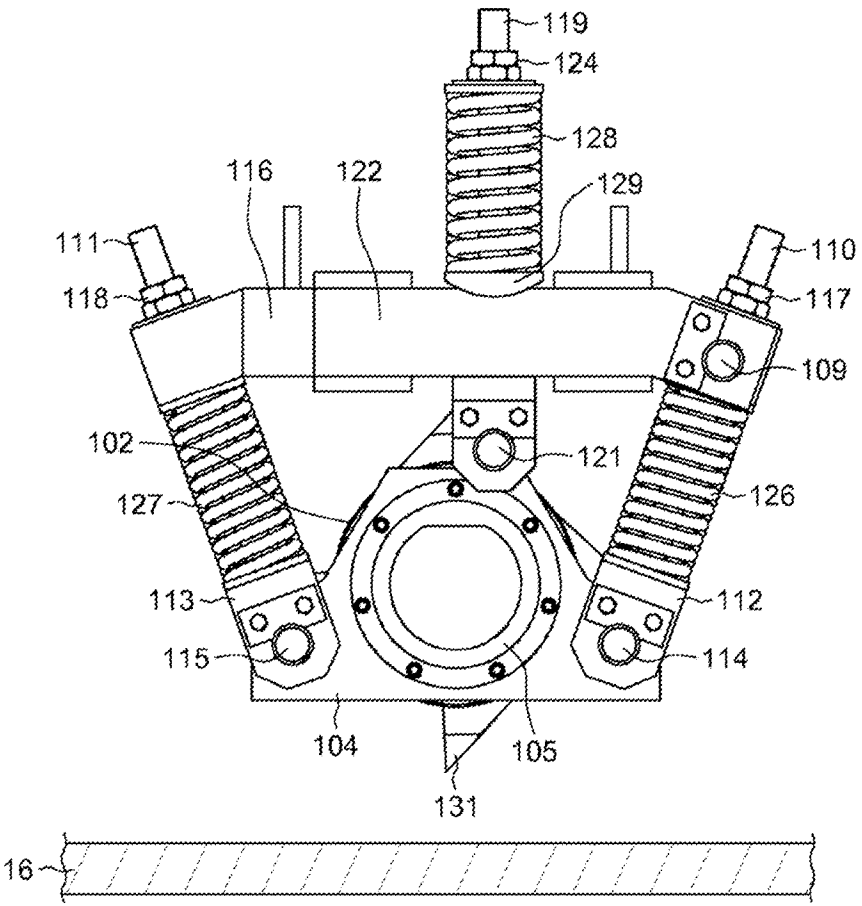
FIG. 8 is a side view of the mechanism having a fragmentation roller of FIG. 7.

As illustrated in particular in FIGS. 4, 7 and 8, the mechanism 101 comprises a driven rotary transverse fragmentation roller 102 which is carried by suspension means 103 which are mounted on the fixed chassis 21.

The suspension means 103 comprise end rocker arms 104 which carry the ends of the roller 102, of which one is provided with a drive motor, for example, a hydraulic drive motor 105.

The suspension means 103 further comprise an upper cradle 106 which comprises lateral supports 107 which are connected by cross-members 108 and articulated to the fixed chassis 21 by means of transverse pivots 109.

The end rocker arms 104 are connected to the lateral supports 107 by means of pairs of front and rear rods 110 and 111 whose lower ends are provided with heads 112 and 113 which are articulated, at one side and the other of the ends of the roller 102, to the rocker arms 104 by means of transverse pivots 114 and 115 and which slide freely through longitudinal arms 116 of the lateral supports 107, the upper ends of the rods 110 and 111 being provided with adjustment nuts 117 and 118. The rods 110 and 111 are arranged so as to form upwardly open V-like members.

The suspension means 103 further comprise central rods 119, which are substantially vertical and the lower ends of which are provided with heads 120 which are articulated to the fixed chassis 21 by means of transverse pivots 121 and which slide freely through longitudinal arms 122 of the lateral supports 107. The longitudinal arms 116 and the longitudinal arms 122, which are located beside each other, are parallel and are connected by transverse plates 123. The upper ends of the central rods 119 are provided with adjustment nuts 124.

The heads 120 have shoulders 125 against which the longitudinal arms 122 can move into abutment.

The suspension means 103 also comprise restoring means for returning the roller 102 toward a position of equilibrium.

Those restoring means comprise pairs of springs 126 and 127 which are arranged around the rods 110 and 111, between the heads 112 and 113 and the end portions of the longitudinal arms 116, the pretensioning of those springs 126 and 127 being brought about by the nuts 117 and 118.

Those restoring means also comprise central springs 128 which are arranged around the rods 119, between the longitudinal arms 122 by means of washers 129 and the nuts 124, by means of washers 130, the pretensioning of those springs 128 being brought about by the nuts 124.

According to a variant illustrated in FIG. 4, the roller 102 is cylindrical and is provided at the periphery thereof with fitted projecting studs or fingers 131 which are partially engaged in housings of the roller 102 and which are fixed by means of screws 132.

According to another variant illustrated in FIG. 7, the roller 102 is cylindrical and is provided at the periphery thereof with projecting studs or fingers 133 which are screwed directly in housings of the transverse roller.

The mechanism 101 may operate as follows.

In the lower position of equilibrium of the fragmentation roller 102, on the one hand, the cradle 106 is in a lower position, the longitudinal arms 116 being pretensioned so as to be in abutment with the shoulders 125 of the heads 120 of the rods 119 under the effect of the springs 128, and, on the other hand, the nuts 117 and 118 are in abutment with the longitudinal arms 116 under the effect of the springs 126 and 127.

The cooling of the metal M over the travel thereof upstream of the mechanism 101 is such that the fragments of metal M are solidified when they reach that mechanism 101.

When the fragments of metal M move on the plate 16 of the second longitudinal table 5 and pass under the roller 102 which is driven in rotation, the fingers of the transverse roller 102 can encounter the fragments, in particular the largest and/or the piles of fragments, and bring about, where applicable, the fragmentation thereof by striking or punching.

In the case of fragments which are too large or heaps of fragments which are too thick, the transverse roller 102 may have a tendency to lift and to move in an upstream and/or downstream direction, by being displaced upward and/or tilting of the end rocker arms 104, with the restoring springs 126 and 127 being compressed.

In the case of fragments which are even larger or heaps of fragments which are even thicker, the transverse roller 102 may have a tendency again to lift. In that case, in order to compensate for the additional constraints acting on the transverse roller 102, the cradle 106 is the component which may rise by pivoting about the transverse pivots 109, moving away from the shoulders 125 and compressing the central springs 128.

The springs 126 and 127, on the one hand, and the central springs 128, on the other hand, have such dimensions and are so pretensioned that the increase in the effects of fragmentation above, resulting from the progressive nature above of the lifting actions of the transverse roller 102, is brought about as a result of the fact that the springs 126 and 127 act counter to the lifting action of the transverse roller 102 over a first path and that the central springs 128 act in addition to the springs 126 and 127 in order to act counter to an additional lifting action of the transverse roller 102 over a second path extending the first path upward.

According to a construction variant, the mechanism 101 having a transverse fragmentation roller 102 could be provided at a different location along the longitudinal tables 4 and 5. According to another construction variant, a plurality of mechanisms 101 which have a transverse fragmentation roller 102 and which are spaced apart could be provided along one or more longitudinal tables 4 and 5.

According to a construction variant, the cradle 106 which is mounted so as to pivot could be replaced by vertical sliding means which carry the rocker arms 104 and which are subjected to central springs which are equivalent to the central springs 128.

Figure 9:
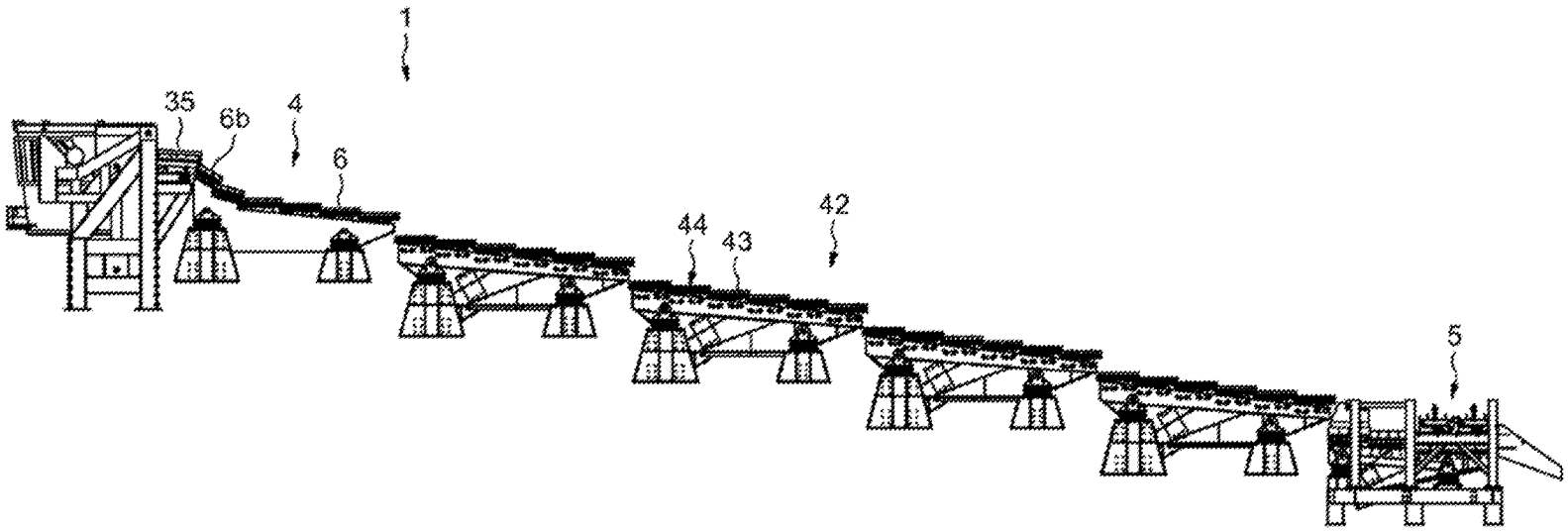
FIG. 9 illustrates a construction variant of the installation.

According to a construction variant illustrated in FIG. 9, the installation 1 comprises, between the first table 4 and the last table 5 described above, a plurality of successive intermediate vibrating tables 42, which comprise a plurality of successive plates 43, of copper, respectively, which define receiving surfaces of the metal 44 and which are provided with vibrating drive means which may be equivalent to those described above, respectively.

As in the case of the plates of the tables 4 and 5, the successive plates 43 of each intermediate table 42 overlap slightly, the upstream plates having transverse downstream edges which are positioned on transverse upstream edges of the downstream plates, the upper face of each plate being substantially horizontal.

The downstream end edges of the plates of the intermediate tables 42 are located above and with spacing from the upstream end edges of the upstream plates of the tables which follow them, in such a manner that each one can vibrate independently. The falls of the metal M thereby brought about may be much smaller than the great fall which occurs between the first table 4 and the first of the intermediate tables 43.

The great fall of the metal M which is provided for above between the table 4 and the table 5 is thus brought about between the first table 4 and the first of those intermediate tables.

As illustrated in a highlighted manner in FIG. 9, the first plate(s) 6*b*, which define(s) an upstream zone, of the first table 4 are inclined in a downstream direction, in such a manner that, when the metal M is poured out from the ramp 35, that inclination produces an effect of driving the metal M in a downstream direction and prevents the metal from remaining on those plates, thereby making the cooling more effective and protecting the plates against any risks of the metal of the plates being torn and perforated. For example, that inclination may be between two and ten degrees.

According to a construction variant, the plate 16 which is located below the mechanism(s) 101 could be provided on a last vibrating receiving table which is independent of the preceding receiving tables.

Furthermore, the mechanism 101 having a transverse fragmentation roller and the cooling means which produce, on the receiving table(s), a first cooling zone using a cooling liquid/gas emulsion and a second zone using only a cooling liquid could be used in an installation having different structure and operation.

Furthermore, one or more mechanism(s) 101 having transverse fragmentation rollers could be provided above preceding tables, in particular on at least one of the intermediate tables 42, with steel plates preferably being provided below those mechanisms.

The present invention is not limited to the example described above. A large number of other construction variants are possible without departing from the scope of the invention.

The invention claimed is:

1. A method for converting a metal in a liquid state into a fragmented metal in a solid state, on at least two tables which are mutually successive, comprising pouring the metal in the liquid state on an upstream portion which is inclined in a downstream direction of a first receiving surface (7) of a first cooled table (4);

vibrating the first table so that the metal moves toward a downstream end of the receiving surface of that first table;

causing the metal to fall from the downstream end of the first table onto an upstream portion of a second receiving surface (17) of a second cooled table (5);

vibrating the second table so that the metal moves toward a downstream end of the second receiving surface of that second table;

passing the metal below at least one rotary transverse fragmentation roller (102) which is positioned above a last vibrating table which is located downstream of the first table (5);

vibrating the last vibrating table so that the metal moves toward a downstream end of a receiving surface of that last vibrating table; and discharging the fragmented and solidified metal at the downstream end of the receiving surface of that last vibrating table.

2. The method as claimed in claim 1, wherein the metal is solidified when it reaches the at least one fragmentation roller (102).

3. The method as claimed in claim 1, comprising circulating an emulsion of a liquid and a gas in transverse channels (24) of an upstream cooling zone and circulating a liquid in transverse channels (32) of a downstream cooling zone, those cooling zones being mutually successive in the longitudinal direction of the receiving tables.

4. The method as claimed in claim 1, wherein the second table constitutes the last vibrating table (5).

5. The method as claimed in claim 1, comprising:

passing the metal on the receiving surface of at least one cooled intermediate table which is located between the second table and the last vibrating table, causing the metal to fall from one table to the other; and vibrating the at least one intermediate table so that the metal moves toward a downstream end of the receiving surface of that at least one intermediate table.

6. The method as claimed in claim 1, wherein the at least one fragmentation roller (102) is subjected, over a first path, to first springs (126, 127) and, over a second path which extends from the first path, to second springs (128) which supplement the first springs.

7. An installation for converting a metal in a liquid state into a fragmented metal in a solid state, comprising:

a first vibrating table (4) comprising a first receiving surface (6) for the metal in the liquid state, the first table having an upstream end and a downstream discharge end, cooling means (24) for the first table, means (14) for vibrating the first table so that the metal moves in a downstream direction;

means (35, 37) for pouring the metal in the liquid state on an upstream portion of the first receiving surface (7) of the first table (4);

a second vibrating table (5) comprising a second receiving surface (17) for the metal in the liquid state having an upstream end (17*a*) and a downstream discharge end, the upstream end (17*a*) of the receiving surface of the second table (5) being located below and with spacing from the downstream end (17*b*) of the first receiving surface (7) of the first table (4), so that the metal falls from the first table (4) on the second table (5), cooling means (32) for the second table (5), means (23) for vibrating the second table (5) so that the metal moves in a downstream direction; and at least one rotary fragmentation roller (102) which is positioned above a last vibrating table and transversely to the movement of the metal on that table.

8. The installation as claimed in claim 7, wherein the second table constitutes the last vibrating table.

9. The installation as claimed in claim 7, comprising at least one intermediate table which is located between the second table and the last vibrating table, means for vibrating that at least one intermediate table and cooling means for that at least one intermediate table.

10. The installation as claimed in claim 7, wherein the tables comprise receiving plates which are selected to be of copper, with the exception of at least a portion of the last vibrating table which is located below the at least one fragmentation roller which comprises a plate which is selected to be of steel.

11. The installation as claimed claim 7, wherein the means for vibrating the tables are shared.

12. The installation as claimed in claim 7, wherein the means for vibrating the tables are independent.

13. The installation as claimed in claim 7, wherein the tables comprise plates (6, 15, 16), the cooling means having circulation channels for a cooling fluid, which are configured inside those plates.

14. The installation as claimed in claim 7, wherein the tables comprise, in an upstream zone of the installation, at least one plate (6) having circulation channels (24) which are provided with injectors (27) for a cooling liquid/gas emulsion and, in a downstream zone following the upstream zone, at least one plate (15) which has circulation channels (32) for a cooling liquid.

15. The installation as claimed in claim 7, comprising suspension means for the at least one fragmentation roller including restoring springs.

16. The installation as claimed in claim 15, wherein the suspension means (103) comprise rocker arms (104), on which the ends of the at least one fragmentation roller (102) are mounted so as to rotate, movable support means (107) for those rocker arms, restoring means (126, 127) for the at least one fragmentation roller acting counter to the movements of the rocker arms in relation to the movable support means and restoring means (128) acting counter to the movements of the movable supports (107).

17. The installation as claimed in claim 16, wherein the restoring means (126, 127, 128) are pretensioned at the position of equilibrium.

18. The installation as claimed in claim 7, wherein the at least one fragmentation roller (102) is positioned above a downstream portion of the last vibrating table (5).

19. The installation as claimed in claim 7, wherein the at least one fragmentation roller (102) is provided at the periphery thereof with a plurality of projecting fingers (131, 133).

20. The installation as claimed in claim 7, wherein at least the upstream portion of the receiving surface of the first table is inclined in a downstream direction.

21. An installation for converting a metal in a liquid state into a fragmented metal in a solid state, comprising:

a plurality of vibrating tables which are provided with receiving plates which are mutually successive in a downstream direction and which have receiving surfaces for the metal;

means (35, 37) for pouring the metal in the liquid state on an upstream portion of an upstream table (4);

means (23) for vibrating the tables (5) so that the metal moves in a downstream direction, at least one rotary fragmentation roller (102) which is positioned above a downstream table (5) and transversely to the movement of the metal on that downstream table; and the receiving plates being selected to be of copper and being provided with cooling means, with the exception of the receiving plate which is located below the at least one rotary fragmentation roller which is selected to be of a steel.

22. The installation as claimed in claim 21, wherein at least two successive receiving plates are offset in the vertical direction so that the metal falls from one on the other.

23. The installation as claimed in claim 21, comprising an upstream zone in which at least one plate (6) has circulation channels (24) which are provided with injectors (27) for a cooling liquid/gas emulsion and a downstream zone which follows the upstream zone and in which at least one plate (15) has circulation channels (32) for a cooling liquid.

24. The installation as claimed in claim 21, comprising suspension means for the at least one fragmentation roller including restoring springs.

25. The installation as claimed in claim 21, wherein at least the upstream portion of the receiving surface of a first table or an upstream table is inclined in a downstream direction.

* * * * *